US005127109A

United States Patent [19]

Heitzman-Powell et al.

[11] Patent Number: 5,127,109

[45] Date of Patent: Jul. 7, 1992

[54] PANTYHOSE

[76] Inventors: Linda S. Heitzman-Powell, 1050 Frayne Dr., New Carlisle, Ohio 45344; Edna M. Heitzman, 1942 Rock Creek, Grove City, Ohio 45345

[21] Appl. No.: 399,020

[22] Filed: Aug. 28, 1989

[51] Int. Cl.[5] ..... A41D 11/00; A41D 11/02

[52] U.S. Cl. ..... 2/409; 2/78 C; 66/177; 66/178 R; 450/104; 450/108; 450/132

[58] Field of Search ..... 2/61, 239, 240, 241, 2/242, 400, 401, 409, 78 C; 66/176, 177, 178 R; 450/104, 108, 124, 132

[56] References Cited

U.S. PATENT DOCUMENTS

| | | | |
|---|---|---|---|
| 557,563 | 4/1896 | Dunning | 2/401 |
| 1,277,074 | 9/1918 | Hitzeman | 2/78 C |
| 1,460,666 | 7/1923 | Gelane | 2/401 |
| 1,587,576 | 6/1926 | Beck . | |
| 1,616,688 | 2/1927 | Gershenow . | |
| 1,832,709 | 11/1931 | Hunter . | |
| 2,093,371 | 9/1937 | Sheehy | 2/224 |
| 2,190,425 | 2/1940 | Hurd | 2/224 |
| 2,318,199 | 5/1943 | Clements | 2/407 |
| 2,381,816 | 8/1945 | Frieman | 450/104 X |
| 2,651,047 | 9/1953 | Emerson | 2/224 |
| 2,719,976 | 10/1955 | Sussman | 450/104 |
| 3,245,410 | 4/1966 | Martin | 450/132 X |
| 3,392,733 | 7/1968 | Blair | 450/132 X |
| 3,474,465 | 10/1969 | Artzt | 2/113 |
| 3,486,507 | 12/1969 | Bregenezer et al. | 450/104 |
| 3,757,354 | 9/1973 | Moody | 2/224 |
| 3,909,851 | 10/1975 | Garrou et al. | 2/409 |
| 3,914,799 | 10/1975 | Newmar | 2/409 |
| 4,150,554 | 4/1979 | Cassidy | 66/172 |
| 4,213,312 | 7/1980 | Safrit et al. | 2/409 X |
| 4,341,095 | 7/1982 | Potent | 66/177 |
| 4,400,832 | 8/1983 | Kinder | 2/406 |
| 4,412,433 | 11/1983 | Safrit et al. | 2/409 X |
| 4,541,351 | 9/1985 | Horita | 112/262.2 |
| 4,785,480 | 11/1988 | Polsky | 2/227 |
| 4,875,241 | 10/1989 | Browder, Jr. et al. | 2/409 |
| 4,999,854 | 3/1991 | Fell | 2/409 |

FOREIGN PATENT DOCUMENTS

| | | | |
|---|---|---|---|
| 825532 | 12/1951 | Fed. Rep. of Germany . | |
| 1191122 | 10/1959 | France | 2/409 |
| 2476987 | 9/1981 | France | 2/46 |
| 846 | of 1910 | United Kingdom | 2/404 |

*Primary Examiner*—Werner H. Schroeder
*Assistant Examiner*—Jeanette E. Chapman
*Attorney, Agent, or Firm*—Watkins, Dunbar and Pollick

[57] ABSTRACT

A special elastic pantyhose construction particularly suitable for corpulent women, wherein a single pair of pantyhose leg apparel is provided with a substantially concealed anti-chafing thigh shield portion, so formed as to extend upward from each opposing inward thigh region thereby merging at the crotch area in one essentially contiguous saddle-like formation; said saddle or thigh shield being constructed principally of natural cotton so as to be comfortably absorbent of common body perspiration, while most compatible with the skin; including a preferred embodiment whereby the saddle is sewn integrally into an otherwise conventional pantyhose, or alternate embodiments whereby the saddle is set forth as an insert portion of the pantyhose; the preferred embodiment substantially concealing the presence of the cotton thigh shield saddle by virtue of the contiguous coverage of the internal applique arrangement.

6 Claims, 2 Drawing Sheets

FIG. 1
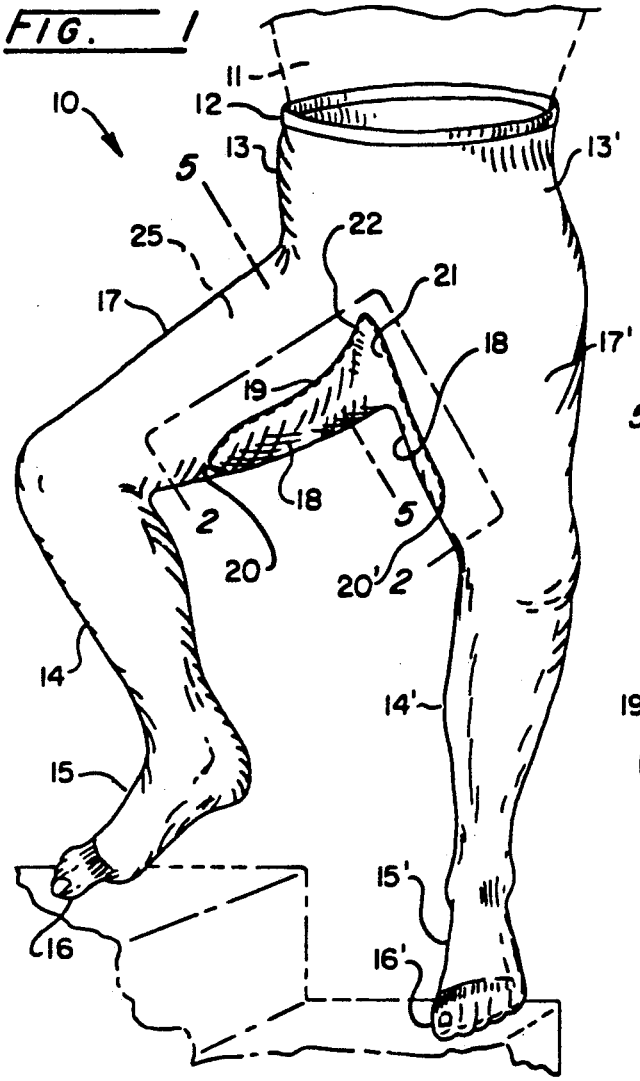
FIG. 2
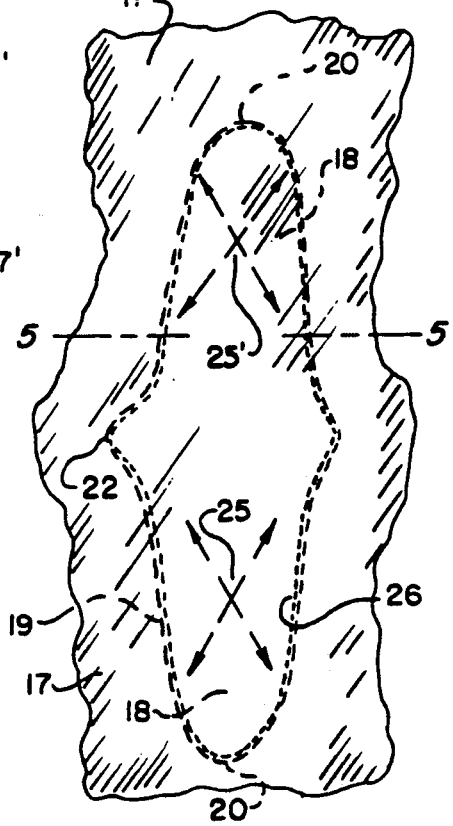
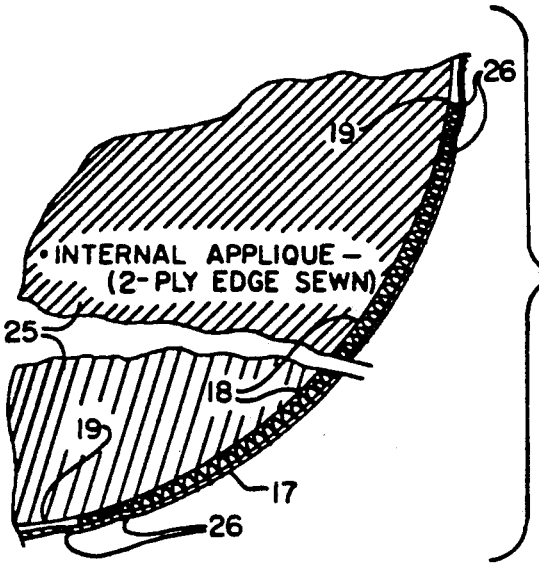
FIG. 5

FIG. 7A-B

PANTYHOSE

FIELD OF THE INVENTION

This invention relates generally to elastic nylon pantyhose apparel, knit of relatively sheer denier nylon yarn, which are often provided with reinforced toe and crotch areas and an elastic waistband region, which are considered adequate for ladies of average weight and are widely sold in quantities of some 1½-billion pairs per year.

BACKGROUND OF THE INVENTION

It is the usual practice to produce conventional non-therapeutic type pantyhose in a single-ply of 10–20 denier weight nylon yarn, which possesses sufficient density in the weave of the knit fabric as to convey a relatively tan appearance over a lady's skin; plus, the said density is normally sufficiently tight as to prevent any noticeable tendency of the skin surface to permeate the weave openings. However, pantyhose worn by a truly corpulent woman (about 30% or more overweight) has the marked physical tendency of expanding circumferentially, particularly in the thigh region, to such an extent as to actually enable the wearer's skin to slightly "bubble through", whereby the skin of one inner thigh region is able to actively abraid upon the nylon surface of the opposing thigh region while walking. Such inter-thigh abrasion would not be apparent to a woman of average weight and thigh circumference; hence, an adverse condition is hereby identified which is both physically and visually undesirable, particularly as to the excessive weight nature of the wearer. It is realized that a sizable annual market of some 150-million pairs exists for a special type of "Superqueen" pantyhose that would overcome this excessive stretch and thigh contact problem, which ordinary queen-size pantyhose does not facilitate comfortably.

Many prior art practitioners have sought to improve undergarments by the insertion of panels and reinforcements and some have employed differing materials for this purpose. However, none have addressed the problem to which this invention is directed.

For example, U.S. Pat. No. 2,651,047 Emerson reveals a woman's form fitting undergarment including novel crotch construction locating the seams of the undergarment. No attention is given to the "overstretch" elasticity problem of synthetic yarn materials found in pantyhose.

U.S. Pat. No. 2,093,371 Sheehy is directed to providing an anti-twist characteristic to the legs of the undergarment by the insertion of inserts longitudinally oriented to structurally resist twisting.

U.S. Pat. No. 4,341,095 Potent describes an elastic cotton crotch insert having different size cotton yarn recognizing the desirable characteristics of softer natural yarn materials. No showing is made of the problems associated with overstretched knitted materials in the thigh areas.

U.S. Pat. No. 1,832,709 Hunter discloses an undergarment made of an outer layer of silk rayon material and an inner layer of cotton wool material. There is no teaching of the problems of overstretched elasticity in the synthetic material in the thigh areas.

French Patent No. 1,191,122 Plailly teaches a pantyhose knitted with threads or yarns of different thicknesses with each thread and thickness used for a specific part of the hose. Although a reinforcement piece is shown in the crotch area there is no teaching of the prior art problem of skin perforation by overstretched yarn fabric.

U.S. Pat. No. 1,587,576 Beck shows an undergarment with a reinforced crotch cut on the bias to permit the goods to stretch longitudinally and relieve the circumferencial tightness of the leg portion.

To more clearly understand this invention it must be perceived that when the conventional pantyhose, which is constructed from synthetic elastic yarn that is relatively fine, of small diameter, is overstretched, i.e., stretched to the point that openings are created in the interstitches through which the wearer's skin protrudes through the openings, it is very tight and applies pressure to the skin tissue. This "bubble through", while irritating and uncomfortable, is particularly uncomfortable and painful in the thigh area where the wearer's legs rub together. This invention is directed to alleviating this problem.

Also, it should be noted that the number one complaint among pantyhose wearers is durability which is a factor owing to the desirable sheerness of the product, but one which is also addressed by this invention. The particular intra-knit weave bubble through effect experienced by corpulent females is the primary problem being addressed by this invention.

SUMMARY OF THE INVENTION

In summary this invention is an improvement in a lower body lady's pantyhose garment that is fabricated principally of sheer knit nylon material type construction, that is capable of expanding to accommodating varying sizes and contours, and is provided with an upper waist inlet plus a lower pair of integral leggings. The improvement comprises a special knit fabric thigh shield provision so arranged as to negate contact of the primary nylon fabric upon the inwardly opposed regions of the wearer's thighs. This is for the purposes of eliminating inner thigh chafing particularly among corpulent women. It includes a built-in means of construction whereby the said thigh shield portion is made permanent with the primary garment body portion. Also included is an anti-bubble though provision constructing the thigh shield portion of softer material whereby the wearer's skin is prevented from any actual inner thigh frictional contact. Additionally, the thigh shield is made in saddle-like configuration that is formed to provide a central crotch shield portion contiguous with a pair of opposed inner thigh contacting extensions.

With the foregoing factors in mind, it is an object of this invention to set forth a pantyhose garment providing particular "anti bubble-through" relief as desired by overweight women, by virtue of a special applique panel of cotton to be provided inside the pantyhose leggings so as to resultantly interface a more compatible natural fabric upon the inner thigh region of the wearer and to prevent the wearer's skin and flesh from entering the interstitches of the harsher synthetic yarns, in the overstretched thigh area.

Accordingly, it is the further object of this invention to provide said thigh shield applique panel in the form of a quasi-saddle like pattern, whereby the opposite facing internal shields of cotton fabric are of sufficient size as to extend from the lower, inner thigh region upwards to the crotch area, preferably in a single contiguous manner.

It is another object of this invention to provide the said improved pantyhose comfort by virtue of the special cotton fabric saddle shield provision, which is preferably augmented with an integral weaving of Spandex yarn,, in addition to the Spandex yarn often woven into the body of the nylon pantyhose itself; said saddle shield cotton being preferably oriented so that the stretchability yields in approximately 45-degree oblique directions from the vertical, as observed upon the leg of a standing wearer.

It is another object of this invention to provide a cotton based thigh shield configured with a rounded termination portion at the lower thigh regions, so as to alleviate any tendency toward concentrated friction points, which might still cause some discomfort were the thigh shields simply shaped with ordinary square ends.

It is another object of this invention to set forth an alternative nylon pantyhose garment having an integrally formed anti-chafing thigh shield saddle formation which is not sewn as an applique per se, but rather as an "insert" panel portion; otherwise exhibiting the same configuration as the more preferred internal applique version; said single-ply insert construction being of either partial lap seam or butt seam joining arrangement, dependant upon manufacturing preference.

Moreover, while this invention will be further described in conjunction with certain preferred embodiments, it is intended that the invention as set forth will not be limited to such specific features; on the contrary, it is intended to cover all associated alternatives, modifications, and equivalents which may be found within the spirit and scope of the invention, as is further defined in the following specifications.

BRIEF DESCRIPTION OF THE DRAWINGS

FIG. 1 is a ¾-left frontal view of a human female's lower-half torso, shown standing upon a step so as to better display particulars of the invention; including two reference view indicia for subsequent illustration;

FIG. 2 is a flat-pattern projection view taken from the approximately right angle leg splay bend reference in FIG. 1, taken on the line 2—2;

FIG. 5 is an enlarged cross-sectional end view taken along line 5—5 of FIGS. 1 and 2 and is shown severed so that a substantially redundant portion may be removed for overall enlargement within spatial restrictions;

FIG. 7/A-B is an enlarged 2-part cross-sectional end view taken along line 5—5 of FIG. 1 and line 7—7 of FIG. 3 and is shown severed so that a substantially redundant portion may be deleted for overall enlargement within spatial restrictions; and wherein part A shows a different attachment arrangement relative to part B, although both are of a substantially common embodiment.

DETAILED DESCRIPTION OF A PREFERRED EMBODIMENT OF THE BEST MODE

Figure 3:
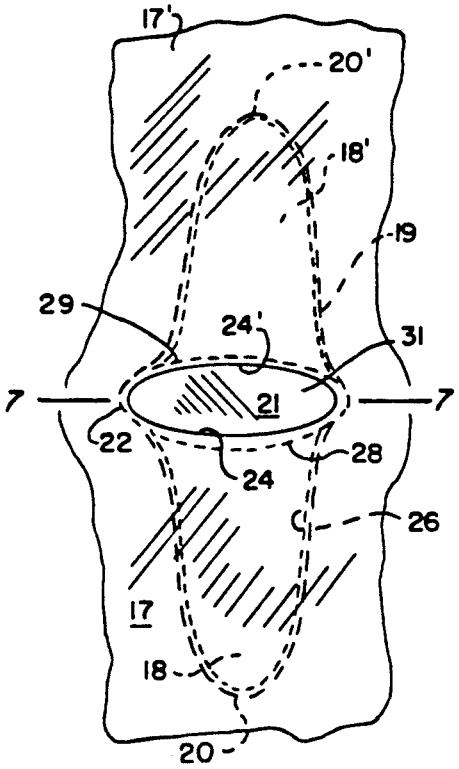
FIG. 3 is another flat-pattern projection view similar to FIG. 2 wherein is shown an alternate embodiment variation thereof.

FIGS. 1 and 2 show the overall invention 10 as it actually appears upon the lower torso of a rather corpulent female whose abdomen 11 is seen rising above the waistband 12 of the substantially conventional pantyhose body covering 13, which is typically of sheer nylon textile material often now interwoven with Spandex Latex yarn courses, that are considered state-of-the-art, thus not treated with any further detail. While FIGS. 1 and 2 do not exhibit a rear view, the preferred embodiment shown in the construction is essentially the same viewed front or rear, so no further full pictorial view is necessary for clarity.

As is typical of pantyhose design, the leggings 14 and footings 15 are portions made integrally with the uppermost abdomen panty portion 13, and the waist 12 may be finished with a conventional elastic band, or built-up from a folded over layer of the nylon stretch material 17 as is taught in U.S. Pat. No. 4,150,554. The lower toe finals 16/16' may be merely seamed closed by a conventional reinforced toe pocket of greater yarn density for du-ability, or, may be finished with a more attractive reinforced toe pocket of gradually increasing density as is taught in U.S. Pat. No. 4,341,097 (both patents by E. L. Cassidy, Sr.).

This invention's special feature is the integral anti-chafe thigh shields 18/18' forming a unique saddle-like portion as is outlined by the perimeter seam edge 19, terminating right and left at the lower rounded tips 20/20'.

Other features of the laterally symmetrical thigh shielding is the central apex 22 and the continuous crotch portion 21. The detailed enlargement in FIG. 2 reveals the flat projected area and overall perimeter outline 19 of the thigh shied as it appears when made as an "applique" to the inside of the leggings 14, whereby only a faint surface seam stitching around perimeter 19 might suggest the presence of the cotton thigh shield 18 as indicated.

Figure 4:
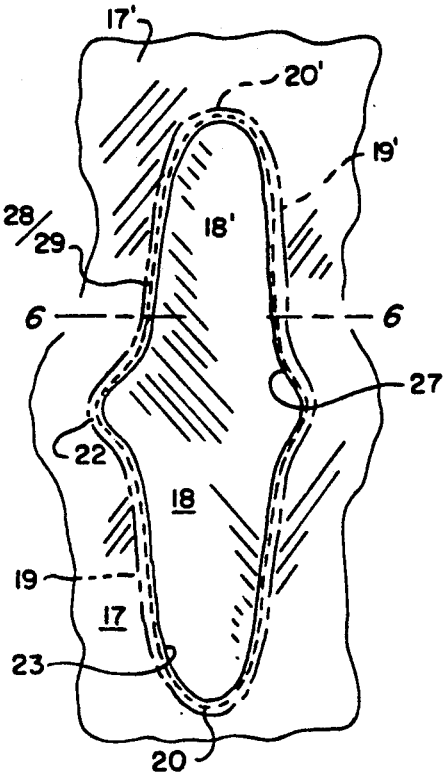
FIG. 4 is another flat-pattern projection view similar to FIG. 2 wherein is shown an alternate embodiment variation thereof.
Figure 4:
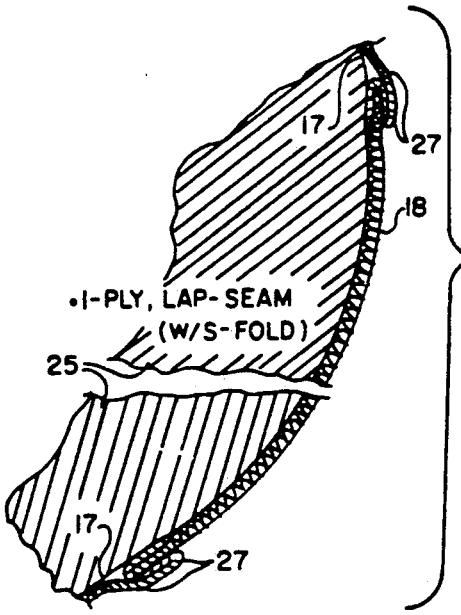

An alternate construction is shown in FIG. 4, clearly revealing the seam perimeter 19' is well defined as an actual absence of the nylon fabric 17/17' surround, whereby is provided the contiguous cotton fabric thigh shield 18, insert embodiment.

Still another practical variation in construction is indicated in FIG. 3, the abbreviated portion 24, whereby only a relatively small truncated pie shaped crotch reveal "breathing port" 31 is provided, so as to again outwardly expose the stretch cotton absorbent material, of the continuous saddle formation of the thigh shield 18/18'. Hence, this embodiment is rather a combination of the former applique embodiment and the latter insert embodiment of the essential anti-chafe thigh shield provision. The crossed Reference arrows 25/25' represent the preferred about 45° oblique bias orientation most elastic yield of the cotton stretch fabric, as it has been discovered to provide a more suitable yielding action in both stretch and recovery conditions.

Figure 6:
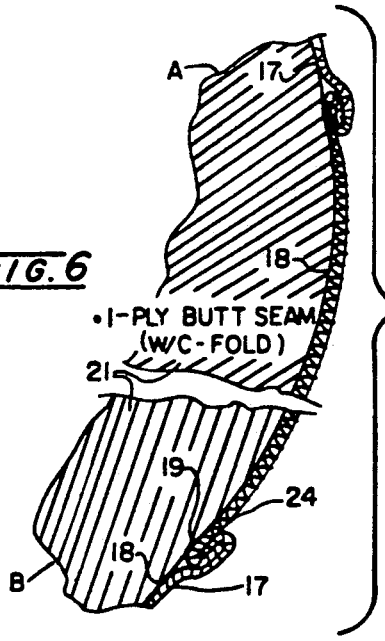
FIG. 6 is an enlarged cross-sectional end view taken along line 5—5 of FIG. 1 and line 6—6 of FIG. 4 and is shown severed so that the substantially redundant portion may be removed for enlargement within spatial restrictions.

Study of FIGS. 5, 6, and 7 reveals the exemplified cross-sectional end view construction of the primary nylon fabric 17 relative to the special cotton fabric 18, wherein FIG. 3 is the most preferred embodiment in that the integrity of the nylon fabric is unsevered and continuous as conventional pantyhose construction, and wherein it is thus exemplified how the perimeter of the thigh shield applique 19 is joined with the nylon leggings fabric via a suitable lap stitch 26 which allows the aggregate 2-ply assemblage to lay substantially flat against the inner thigh region of the wearer's leg 27.

FIG. 4 shows how the 1-ply thigh shield "insert" 18 is attached with a reinforcing S-fold/lap seam, in contrast to the FIG. 7 example, which shows a C-seam of nylon fabric 17 butt joined to the cotton thigh shield saddle 18. Lastly, an attachment arrangement most appropriately applied to the abbreviated portion 24 of FIG. 3, would be the lap seam variation exhibited in the lower section of FIG. 5.

In the drawings and specifications, there has been set forth the best mode presently contemplated for the practice of the present invention, and although specific terms are employed, they are used in a generic if descriptive sense only, and not for purposes of limitation, the scope and spirit of the invention being defined in the claims.

We claim:

1. In a lower body panty hose garment fabricated primarily of sheer nylon-type material construction, capable of expanding to accommodate varying sizes and contours of wearers and openings in large interstitial spaces through which skin of a garment wearer may bubble through and be exposed on the opposite side of the knitted material, and provided with an upper waist inlet plus a pair of integral opposite leggings for covering the thighs of a garment wearer, with the leggings meeting at a crotch in the garment, the improvement comprising:

a) a special knit fabric thigh shield provided and so arranged as to negate contact of the panty hose garment material upon the inwardly opposed and opposite thighs of the wearer, for purposes of eliminating discomforting inner thigh chafing particularly among more corpulent wearers, said thigh shield overlapping the primary knit material of the leggings, at the inner thigh of the wearer and at the crotch in the garment;

b) said elimination of chafing being through the anti-bubble through construction including the thigh shield portion of softer, denser material which bridges in the enlarged interstitial spaces whereby the skin of the garment wearer is prevented from any actual inner thigh frictional contact with the opposite thigh or legging;

c) the thigh shield being of a saddle-like configuration that is formed to provide a central crotch shield portion contiguous with a pair of opposed inner thigh shields; and d) the panty hose garment and thigh shield combination being a 2-ply construction wherein the inside-ply of thigh shield material within each legging is an applique upon the outside-ply of panty hose garment material.

2. An anti-chafing pantyhose article according to claim 1 wherein the material of the thigh shield is an absorbent cotton knit-like fabric, having an integral spandex-yarn for stretchability and recoverability characteristic compatible with that of the panty hose garment material.

3. An anti-chafing pantyhose article according to claim 1 wherein weave orientation means is sewn into the pantyhose garment leggings with the most elastic yield to run obliquely at about 45-degrees relative to the vertical, as viewed upon the leg of a standing wearer; thereby affording maximum fit and comfort.

4. An anti-chafing pantyhose article according to claim 1 wherein said thigh-shield lower extremities are formed in a lower rounded tips, so as to further maximize walking comfort.

5. A lower body panty hose garment fabricated principally of sheer knit nylon-type hose material capable of expanding to accommodate substantial size and contour differences, and provided with a conventional upper-waist inlet to a pair of integral leggings, including a permanent soft cotton-like fabric panel insert servicing as an anti-chafing thigh shield so arranged directly between the thigh contact region of the wearer as to eliminate direct contact of the primary nylon hose-fabric upon the wearer's inner thigh skin, for purpose of negating discomforting skin bubble through effect, particularly among more corpulent persons; comprising:

a) a combination wherein said thigh shield is fastened to the panty hose garment body and arranged symmetrically in a saddle-like insert between the wearer's legs, a relatively small truncated pie shaped opening, in a crotch area of the panty hose so as to outwardly expose the soft cotton-like fabric panel as perceived from the outside of the panty hose garment, and including a central crotch portion formed contiguously with a respective right and left thigh shields which extend approximately two thirds the distance down toward the knee region and extend around toward the back of the leg plus a stretchable weave orientation which yields in approximately 45 degree oblique directions from the vertical by which the said thigh-shield maximizes compliance comforting; and b) wherein said anti-bubble through effect is attained by use of a more skin compatible cotton fabric material having a greater intra-knit density weave, serving to prevent the wearer's skin from otherwise bubbling through the more skin-permeable elastic weave of the nylon-like panty hose material.

6. An anti bubble through fabric according to claim 5, wherein a special combination of materials includes an absorbent cotton-knit weave having an integral spandex yarn intra-structure for improved stretch and recoverability character of the cotton material.

* * * * *